US010745169B2

(12) United States Patent
Capoia et al.

(10) Patent No.: US 10,745,169 B2
(45) Date of Patent: Aug. 18, 2020

(54) UNIT TO WORK RELATIVELY RIGID MATERIAL SUCH AS CARDBOARD, AND RELATIVE WORKING METHOD

(75) Inventors: Giuseppe Capoia, Cimadolmo (IT); Carlo Capoia, San Vendemiano (IT)

(73) Assignee: PANOTEC SRL, Cimadolmo (IT)

( * ) Notice: Subject to any disclaimer, the term of this patent is extended or adjusted under 35 U.S.C. 154(b) by 882 days.

(21) Appl. No.: 13/577,408

(22) PCT Filed: Feb. 4, 2011

(86) PCT No.: PCT/IB2011/000183

§ 371 (c)(1),
(2), (4) Date: Aug. 6, 2012

(87) PCT Pub. No.: WO2011/095878

PCT Pub. Date: Aug. 11, 2011

(65) Prior Publication Data

US 2012/0305636 A1 Dec. 6, 2012

(30) Foreign Application Priority Data

Feb. 4, 2010 (IT) ..... UD2010A0019

(51) Int. Cl.
*B65D 5/50* (2006.01)
*B31B 105/00* (2017.01)
*B31B 120/40* (2017.01)

(52) U.S. Cl.
CPC ..... *B65D 5/5033* (2013.01); *B31B 2105/00* (2017.08); *B31B 2120/40* (2017.08)

(58) Field of Classification Search
CPC ..... B65D 5/5033; B31B 2105/00; B31B 2120/40
USPC ..... 493/70
See application file for complete search history.

(56) References Cited

U.S. PATENT DOCUMENTS

| | | | | |
|---|---|---|---|---|
| 1,791,367 A | | 2/1931 | McVay et al. | |
| 2,979,246 A | | 4/1961 | Liebeskind | |
| 3,801,407 A | * | 4/1974 | Goldsworthy et al. | 156/379.9 |
| 4,211,356 A | * | 7/1980 | Tsuchiya et al. | 206/586 |
| 4,339,039 A | * | 7/1982 | Mykleby | 206/523 |
| 5,070,681 A | * | 12/1991 | Romagnoli | 53/566 |
| 5,192,387 A | * | 3/1993 | Buckley | 156/275.5 |
| 5,532,044 A | * | 7/1996 | Jen | 428/167 |
| 5,827,392 A | * | 10/1998 | Buckley et al. | 156/275.3 |

(Continued)

FOREIGN PATENT DOCUMENTS

| | | |
|---|---|---|
| DE | 1771966 U | 8/1958 |
| EP | 2000294 A2 | 12/2008 |

OTHER PUBLICATIONS

International Search Report and Written Opinion for PCT Application PCT/IB2011/000183, European Intellectual Property Office, dated Jul. 4, 2011.

*Primary Examiner* — Sameh Tawfik
(74) *Attorney, Agent, or Firm* — Themis Law

(57) ABSTRACT

An apparatus and method to work relatively rigid material such as cardboard in sheets, to make boxes. The apparatus includes a loader suitable to have, according to a desired order, substantially flat reinforcement elements, and gripping means movable between a first gripping position in which they cooperate with the loader to pick up the reinforcement elements, and a second positioning condition, in which they position the reinforcement elements on the sheet according to a predetermined positioning pattern.

22 Claims, 4 Drawing Sheets

(56) References Cited

U.S. PATENT DOCUMENTS

| | | | | |
|---|---|---|---|---|
| 6,226,965 | B1 * | 5/2001 | Lam | 53/491 |
| 6,234,943 | B1 * | 5/2001 | Copin | B26D 5/32 493/11 |
| 6,253,817 | B1 * | 7/2001 | Edwards | B65B 7/2807 156/351 |
| 6,354,984 | B1 * | 3/2002 | Hensley | A61F 13/15772 493/11 |
| 6,530,480 | B1 * | 3/2003 | Hardy | 206/586 |
| 6,569,073 | B1 * | 5/2003 | Bridges et al. | 493/183 |
| 6,935,998 | B2 * | 8/2005 | Silvestre | B65H 29/66 493/10 |
| 7,128,869 | B2 * | 10/2006 | Habisreitinger et al. | 264/510 |
| 7,569,007 | B2 * | 8/2009 | Thoma | B65H 45/162 493/11 |
| 7,882,954 | B2 * | 2/2011 | Davlin et al. | 206/522 |
| 7,958,694 | B2 * | 6/2011 | Johansson | B32B 27/20 493/11 |
| 2008/0081754 | A1 * | 4/2008 | Plemons et al. | 493/84 |

* cited by examiner 10
27
29
19
30
13
12
15a
33
30
20
35
32
12
25
26
30
26
22
16
15
23
30
30
"Y"
12
15
15
15
17
15
15
13
13
31
21
15
15
"X"
11
12
15
15

15
15
13
12
11
13
12

12
15
15
13
15

UNIT TO WORK RELATIVELY RIGID MATERIAL SUCH AS CARDBOARD, AND RELATIVE WORKING METHOD

FIELD OF THE INVENTION

The present invention concerns a unit to work relatively rigid material, such as cardboard for example. In particular the present invention can be used in plants to make boxes, packages or, more generally packagings, starting from strips or sheets of relatively rigid material.

Here and hereafter in the description and the claims, by the term sheet we generally mean both pre-cut single sheets and also sheets coming from rolls or strips.

The present invention also concerns the relative method for working such material.

BACKGROUND OF THE INVENTION

In the packing or packaging sector, plants are known which are used to make boxes by means of a plurality of workings on a packaging material, for example a sheet of cardboard.

Known plants generally comprise a plurality of operating units or stations disposed in series and provided with tools, for example cutting tools, pre-creasing tools or others.

In this type of known plant, basically the sheets progress along one or more directions of feed between the different operating units or stations, in order to be subjected at least to the traditional operations of cutting to size with respect to the development of the box, and to pre-creasing and/or cutting, in order to obtain at least the lips and the definitive preferential fold lines of the box.

Known plants also have units or stations for forming and for folding the sheet of cardboard to obtain, at the exit from the plant, a substantially finished box.

In particular, but not only, in order to make boxes intended for the industrial transport of heavy or delicate goods such as electrical appliances, electronic apparatuses, furnishing elements, mechanical components, but not only, it is known to provide that, at the end of the folding of the sheet and the definition of the box, positioning and constraining steps are provided, typically by gluing, of reinforcement elements to the formed box, which also has the function of protecting the contents against knocks.

The reinforcement elements normally consist of blocks of cardboard, wood, polystyrene or other, which are advantageously disposed at the corners and/or the internal or external edges of the box, or in any case in correspondence to the weakest parts of the box, depending on the merchandise contained therein.

The disposition and constraint of the reinforcement elements is carried out at the end of the forming steps of the box, and therefore requires an auxiliary operative intervention on a product that is, in itself, already finished, with consequent operating delays and the risk of compromising the quality of the box itself.

It is also known that, because of the complex positioning operations of the reinforcement elements inside the box, in particular in boxes with an oblong conformation or different from the characteristic parallelepiped one, the reinforcement elements are positioned by hand, with consequent possible inaccuracies and differences in positioning between one box and another.

Moreover, having to provide reinforcements, particularly along the edges and in correspondence to the corners of the box, the reinforcement elements have a complex conformation which develops on two or three Cartesian planes, therefore requiring a specific working and preparation step.

This known operating condition causes an increase in operating time and costs, as well as the need to provide complex separate operating lines for the preparation of the specific reinforcements for the box.

Document EP-A-2.000.294 shows a method to make a box which provides to attach, on a planar blank and in correspondence to four corners, a pre-formed corner element consisting of two faces or walls, converging on a common edge. This conformation can be complex to handle and position, above all having to insert the pre-formed corner element in elaborate box-like structures.

Moreover, the corner element consisting of two converging faces does not adequately protect the content of the box, in that there is always the risk that knocks on parts of the packaged product which are not in direct abutment with the faces of the corner elements can cause surface defects, markings and scratches, which lower the quality of the packaged product. This disadvantage is particularly felt in the case of high-quality and therefore high-cost packaged products, such as furnishing elements or other.

Document U.S. Pat. No. 1,791,367 describes a box-like container comprising spacer elements inside, made of corrugated cardboard, which limit the movement of the packaged products, but do not protect the perimeter of the product efficiently, the corners and sides of which can be exposed to knocks and damage.

One purpose of the present invention is to achieve a working unit and to perfect a method which allow to reduce the times and costs of making the box, in particular with regard to the positioning and constraint of the reinforcement elements.

Another purpose is to adequately protect the packaged product with the boxes which are made, in particular the corners and the overall perimeter.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose, a unit according to the present invention is applied for working relatively rigid material, for example cardboard in sheets, in order to make boxes, and in particular to position and constrain relative reinforcement elements for such boxes.

Advantageously, the unit according to the present invention is applied downstream of units or stations for cutting and/or pre-creasing the sheet, and upstream of units and/or stations for folding the sheets, with respect to the direction of feed of the sheet.

In this way, the working unit according to the present invention is suitable to operate on the cardboard sheet in a substantially flat condition, that is, before its conformation into a box.

According to one aspect of the present invention, the working unit comprises at least loading means suitable to present, according to a desired order, one or more substantially flat reinforcement elements, and gripping means mobile between a first gripping position in which they cooperate with the loading means in order to lift one or more reinforcement elements, and a second positioning condition in which they position the reinforcement elements on the cardboard sheet according to a predetermined positioning pattern.

According to the present invention, the positioning pattern includes at least units formed by three reinforcement elements disposed adjacent along respective edges on the plane of the sheet according to a right-angled travel, so that, by actuating a coordinated folding of lips of the sheet in order to form the box, the reciprocal positioning of the reinforcement elements is defined to substantially form a single corner reinforcement element in which the reinforcement elements are disposed in contact with each other along the respective edges and lie on a coordinated triad of different and reciprocally perpendicular Cartesian planes.

In the folded configuration in which the single three-dimensional corner reinforcement element is defined, there is a first reinforcement element which lies on the plane of the sheet, therefore parallel to it, whereas the other two reinforcement elements are perpendicular to each other and also to the first reinforcement element, and therefore to the sheet, defining and completely closing an angular space of a shape mating with the corners of the product to be packaged.

By the expression "substantially flat" we mean reinforcement elements with a main development on only one Cartesian plane.

With the present invention, providing a positioning of the reinforcement elements on the sheet of cardboard, that is, before the folding for the three-dimensional conformation of the box, it is possible to provide the use of reinforcement elements which are all substantially flat, exploiting the fact that their possible conformation on two or three Cartesian planes is obtained with two or three elements disposed adjacent in proximity to the folding edges.

Indeed, the subsequent folding of the cardboard sheet determines a reciprocal positioning on two or three Cartesian planes of the reinforcement elements provided.

Furthermore, the present invention guarantees the perimeter protection of the packaged product, even if it has irregular, complex or unusual shapes, in correspondence to each corner or edge, on a triad of reciprocally perpendicular planes which completely cover and protect the corners of the packaged product, and therefore its perimeter, therefore preventing possible damage from scratches, knocks or crushing.

Moreover, in this way, it is also possible to integrate into the typical production steps of the box the step of positioning the reinforcement elements, without needing to provide manual interventions at the end of the production process, irrespective of the final shape of the box. This advantage leads to a considerable reduction in production times and costs, as well as a repeatability of positioning of the reinforcements in the box.

Moreover, with the present invention, there is no need to provide complex separate operating lines for the preparation of the reinforcements. This advantage leads to a reduction in management costs of the production process of the box, as well as a substantial reduction in the installation bulk of the whole production plant.

According to a variant, the unit according to the present invention comprises constraint means configured to determine the reciprocal constraint of the reinforcement elements and the sheet of cardboard.

These means allow to ensure the maintenance of the correct positioning of the reinforcement elements during and after the folding steps of the cardboard sheet.

According to a variant, the constraint means comprise a member for depositing an adhesive.

This variant solution allows an optimal condition of constraint of the reinforcement elements and the sheet, with substantially reduced operating times and therefore costs.

In some solutions, the adhesive is deposited on the cardboard sheet in correspondence to the positioning zones of the reinforcement elements, before the positioning of the relative reinforcement elements by the gripping means.

In other solutions, the adhesive is deposited on the reinforcement elements before the latter are positioned on the sheet by the gripping means.

In other solutions, the adhesive is deposited both on the cardboard sheet and also on the reinforcement elements.

The choice of one or the other of the solutions for depositing the adhesive can be made according to desired constraint conditions, or shapes and sizes of the single reinforcement elements, or the material of which they are made, or other operating or design conditions.

By the term adhesive we generically mean any chemical or natural compound which, alone, or composed of a primer and a base, is able to determine a rigid adhesion of two bodies.

According to another variant, the constraint means comprise a member for the insertion of mechanical members, such as metal tacks, nails, rivets or other, in order to determine the constraint of the reinforcement elements and the sheet.

This variant solution is particularly advantageous in the case where the sheet and the reinforcement elements consist of materials which are not easily glued together.

According to another variant, the loading means comprise a cutting member, suitable to cut to size the reinforcement elements, for example starting from a semi-worked piece.

This advantageous solution allows to further optimize the production times of the box, since it is possible to provide the production of the reinforcement elements, on each occasion, as a function of the real operating and positioning needs.

According to another variant, the working unit according to the present invention provides a marker member, disposed upstream of the gripping means with respect to the direction of feed of the sheet.

The marker member is suitable to deposit a plurality of locators on the sheet, according to the predetermined positioning pattern, and to identify the zones on which the gripping means go to position the reinforcement elements.

In some solutions, the marker member identifies the above zones by means of printing, according to other solutions by means of contained incisions.

In the variant solution in which a marker member is provided, both the gripping means and the possible constraint means can be equipped with reading members, such as for example sensor means, optical, optoelectronic, video or similar sensors, able to identify the locators deposited by the marker member, in order to position thereon the reinforcement elements, or to deposit the adhesive.

In some forms of embodiment, the present invention comprises optical viewing means, possibly coinciding with the reading members, suitable to form an image of part of the sheet in order to identify the locators.

In further forms of embodiment, the present invention comprises optical viewing means suitable to form an image of the reinforcement elements fed by the loading means.

In some forms of embodiment, the gripping means comprise the optical viewing means and are able to move then respectively in correspondence to the reinforcement elements and/or the locators.

In some forms of embodiment, the optical viewing means themselves are provided to control the sheet and to identify one or more selected reinforcement elements fed by the loading means, according to a determinate positioning destination on the sheet identified depending on a mating locator.

The present invention also concerns a unit for working relatively rigid material, for example cardboard sheets, to make boxes. The unit comprises at least loading means suitable to have, according to a desired order, one or more substantially flat reinforcement elements and at least a marker member able to deposit a plurality of locators on the sheet in order to identify the zones on which to position the reinforcement elements according to a predetermined positioning pattern. The pattern includes at least units formed by three reinforcement elements disposed adjacent along respective edges on the plane of the sheet according to a right-angled travel, so that, by actuating a coordinated folding of the lips of the sheet to form the box, the reciprocal positioning of the reinforcement elements is defined, so as to faun substantially a single corner reinforcement element in which the reinforcement elements are disposed in contact with each other along the respective edges and lie on a coordinated triad of different Cartesian planes.

The working unit also comprises optical viewing means cooperating at least with feed means to feed the sheets so as to acquire images of the sheets fed, and to transmit them to a command and control unit which is configured to recognize, according to the images acquired, at least the type of format of the sheet so as to coordinate the automatic functioning of the marker member.

In variant embodiments, the working unit comprises gripping means mobile between a first gripping position in which they cooperate with the loading means to pick up one or more of the reinforcement elements, and a second positioning condition, in which they automatically position, according to commands received from the command and control unit, the reinforcement elements on the sheet, according to the predetermined positioning pattern.

The use of the optical viewing means allows to manage and select different types of reinforcement elements, to be disposed depending on the different sheet formats to be folded in order to make the boxes, which are fed each time along the working line; it is therefore possible to produce, with the same line, boxes of different sizes. Indeed, with the optical viewing means it is possible to position with precision the desired reinforcement elements in the appropriate positions.

The present invention also concerns a method for working relatively rigid material, such as cardboard in sheets, in order to make boxes. The method provides a feed step of the sheet along a direction of movement, on which sheet specific cuts and pre-creasing have been made along the direction of movement so as to define relative lips and fold lines on the sheet, at least a step of positioning on the sheet, in correspondence at least to corners identified by the junction of the fold lines, substantially flat reinforcement elements according to a predetermined positioning pattern which includes at least units foamed by three reinforcement elements disposed adjacent along respective edges on the plane of the sheet according to a right-angled travel mating with the respective angle in correspondence to which the reinforcement elements are positioned. The method also includes a coordinated step of folding the lips of the sheet to form the box, so as to define the reciprocal positioning of the elements in order to form substantially a single corner reinforcement element in which the reinforcement elements are disposed in contact with each other along the respective edges and lie on a coordinated triad of different Cartesian planes.

In some forms of execution, the method comprises at least a loading step in which by means of loading means one or more of the substantially flat reinforcement elements are presented to gripping means according to a desired order, and in the positioning step the reinforcement elements are picked up by the loading means and positioned on the sheet according to the predetermined positioning pattern, by means of the gripping means mobile between a first gripping position and a second positioning position.

In some forms of execution, the method comprises a marking step in which to deposit, by means of a marker member, a plurality of locators on the sheet in order to identify the zones on which to position the reinforcement elements according to the predetermined positioning pattern, and an optical viewing step to acquire images of the sheets fed by feed means and to transmit them to a command and control unit which recognizes, according to the images acquired, at least the type of format of the sheet and automatically coordinates the marking step.

BRIEF DESCRIPTION OF THE DRAWINGS

These and other characteristics of the present invention will become apparent from the following description of a preferential form of embodiment, given as a non-restrictive example with reference to the attached drawings wherein.

Figure 1:
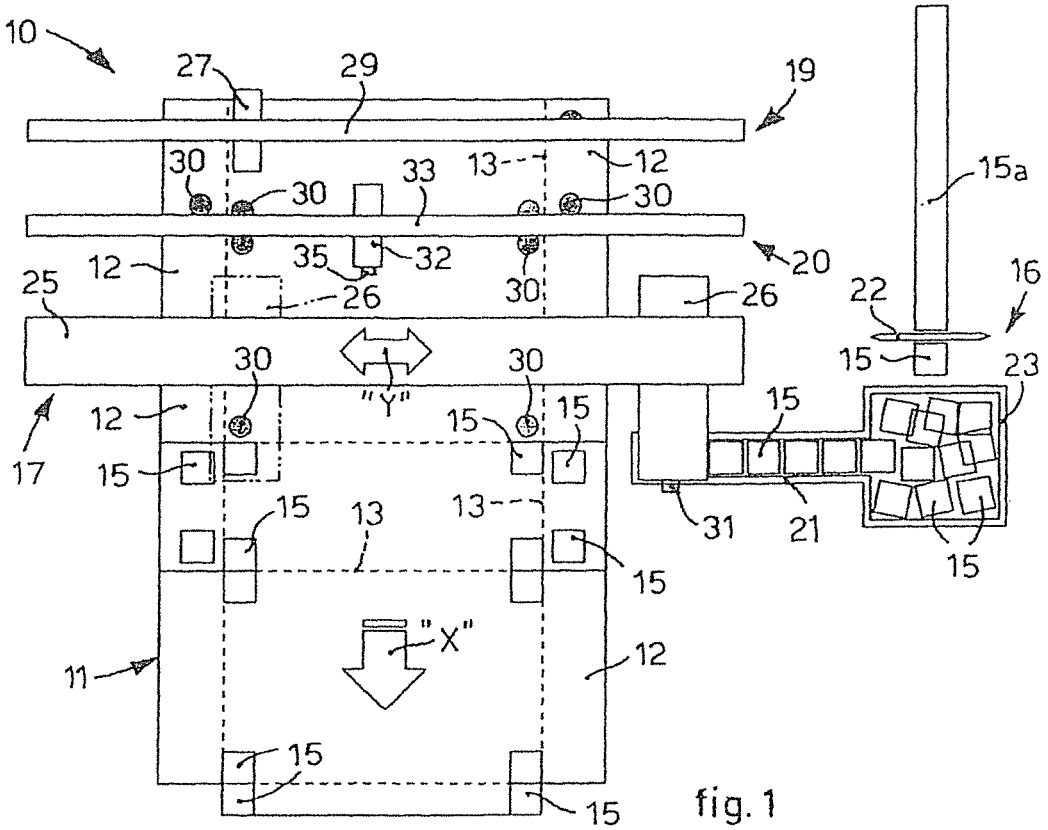
FIG. 1 shows schematically from above a working unit according to the present invention.

To facilitate comprehension, the same reference numbers have been used, where possible, to identify common elements in the drawings that are substantially identical. It is understood that elements and characteristics of one form of embodiment can conveniently be incorporated into other forms of embodiment without further clarifications.

DETAILED DESCRIPTION OF A PREFERENTIAL FORM OF EMBODIMENT

With reference to FIG. 1, the reference number 10 indicates in its entirety a unit for working a sheet 11 of relatively rigid material, in this case, cardboard, to make a containing or packaging box.

The unit 10 according to the present invention is applied in a larger plant, of the type substantially known and not shown here, to make boxes, starting from sheets 11 of cardboard.

The sheets 11 of cardboard are fed along a direction of feed X, shown by an arrow in FIG. 1.

To give a non restrictive example, the plant in which the unit 10 is installed comprises a cutting and/or pre-creasing station, not shown, disposed upstream of the unit 10, with respect to the direction of feed X, and able to carry out specific cutting and pre-creasing workings along the first direction X, so as to define relative lips 12 and fold lines 13 on the sheet 11, so as to guide and facilitate the subsequent folding steps of the sheet 11, and define the box.

The plant provides, downstream of the unit 10 with respect to the direction of feed X, a folding station, of the known type and not shown here, in which the lips 12 of the sheet 11 are reciprocally folded along the fold lines 13, so as to define the box.

The unit 10 is applied to position, according to a predetermined positioning pattern, a plurality of reinforcement elements 15 on the sheet 11 in an open condition, that is, not yet folded, advantageously in correspondence to the corners defined by the junctions of the fold lines 13.

According to the present invention, the positioning pattern includes at least units formed by three reinforcement elements 15 disposed adjacent along their respective edges on the plane of the sheet 11 according to a right-angled travel, mating with the corner of the sheet 11 defined by the junction of the fold lines 13 in correspondence to which the reinforcement elements 15 are located, of which a first reinforcement element constitutes the top, while the other two reinforcement elements are disposed at 90° to the respective sides of the first reinforcement element, so that by folding the sheet 11 the first reinforcement element lies on the plane of the sheet 11, therefore parallel to it, while the other two reinforcement elements are perpendicular with respect to each other and also to the first reinforcement element, and therefore to the sheet 11, defining and completely closing an angular space of a shape mating with the corners of the product to be packaged.

In particular the unit 10 comprises a loader 16, a robotized manipulator 17, a marker 19 and an apparatus to deposit adhesive 20.

In this case, the loader 16 comprises a feeder 21 configured to present, in sequence, the reinforcement elements 15 to the robotized manipulator 17.

Moreover, the loader 16 comprises a cutting member 22 and a loading hopper 23.

The cutting member 22 is, for example, a circular blade, suitable for cutting the reinforcement elements 15 to the desired sizes, starting from a semi-worked piece of the same material.

In this case, the reinforcement elements 15 are made of polymer material, for example polystyrene, and are made by progressively cutting a plurality of pieces, in this case equal to each other, from the same bar of polystyrene 15*a*.

In variant embodiments, the reinforcement elements 15 can be made of other materials, for example cork, cardboard or any material suitable to at least partly absorb knocks and to protect the packaged product. Moreover, reinforcement elements 15 made of material of different nature, color, thickness can also be used, for the same box, according to specific needs.

In the case shown, each reinforcement element 15 is configured as a block with a substantially parallelepiped shape and a square or rectangular base, with main extension on only one Cartesian plane.

Advantageously, the lateral reinforcement elements 15 in the right-angled configuration described above have a height substantially equal to the thickness of the product to be packaged, so as to protect it completely from lateral knocks.

The pieces cut by the cutting member 22 are disposed in the loading hopper 23, which is directly connected to the feeder 21.

The reinforcement elements 15 are then passed by the loading hopper 23 to the feeder 21, and then presented, according to a desired sequence of presentation, to the robotized manipulator 17.

The robotized manipulator 17 comprises, in this case, a support bridge 25 and a gripping head 26, the latter assembled sliding on the support bridge 25, along the direction of work indicated by the arrow Y. In this case, the direction of work Y is substantially perpendicular to the direction of feed X.

The support bridge 25 is operatively disposed above and transversely with respect to the sheet 11.

The gripping head 26 is mobile between a first gripping position, in which it is in correspondence to the feeder 21, in order to pick up the reinforcement elements 15 extracting them from the feeder 21, and a second positioning position in which it is above the sheet 11 and positions the various reinforcement elements 15 on the sheet 11, according to the predetermined positioning pattern.

The gripping head 26 can be of any known type, for example suction cap, pincers or other known type, depending on the range of sizes and materials with which the reinforcement elements 15 are made.

In this case, the gripping head 26 also comprises a sensor device 31, assembled on the gripping head 26 and mobile with it; its function will be described in detail hereafter.

The sensor device 31 can be an optical or electromagnetic reading member, a viewing and image acquisition member such as a camera, for example CMOS or CCD, or other suitable member.

It is not excluded, according to a variant, that instead of providing the support bridge 25 and the sliding gripping head 26, the robotized manipulator 17 may comprise a robotized anthropomorphic arm, programmed or programmable, so as to move the relative gripping head 26 between the first gripping position and the second positioning position.

In this case, the marker 19 is provided upstream of the robotized manipulator 17, with respect to the direction of feed X of the sheet 11.

The marker 19 comprises a marker head 27 disposed above the sheet 11 and assembled sliding on a transverse guide 29, so as to be able to selectively move in a transverse direction to the direction of feed X.

The marker head 27 is configured so as to deposit a plurality of locators 30 on the head 11 in correspondence to the predefined zones on which the gripping head 26 of the robotized manipulator 17 will position the reinforcement elements 15.

Thanks to the action of the sensor device 31 mounted on the gripping head 26, the robotized manipulator 17 is able to detect the locators 30 deposited on the predefined positioning zones of the reinforcement elements 15, and therefore to move the gripping head 26 correctly and with precision, according to the predefined positioning pattern of the reinforcement elements 15.

In this case, the locators 30 consist of identifying tracks obtained by printing on the surface of the sheet 11.

According to a variant, the locators 30 consist of small incisions carried out on the sheet 11, or the deposit of contained metal elements.

In other forms of embodiment the locators 30 can be differently colored elements, according to needs, printed or applied, or univocal optoelectronic recognition elements, printed or applied, such as bar codes or similar technology for recognizing identification signs, or even more complex elements such as RFID tags.

The choice of one or other of the possible locators 30 to be adopted can depend on the different types of sensor devices 31 which are to be used, on the types of material of which the sheet 11 and the reinforcement elements 15 are made, or other operating and/or design parameters.

It is clear that, depending on the locators 30 used, the person of skill will select the most suitable sensor device 31 from among those available for the specific technology.

The apparatus for depositing adhesive 20 is in this case disposed in an intermediate position between the marker 19 and the robotized manipulator 17, with respect to the direction of feed X.

The apparatus for depositing adhesive 20 comprises a depositing head 32 disposed above the sheet 11 and mounted sliding on a transverse guide 33, so as to be able to move selectively in a direction transverse to the direction of feed X.

The depositing head 32 is suitable to deposit a desired layer of adhesive in correspondence to the zones of the sheet 11 identified with the locators 30. In this way, the attachment of the reinforcement elements 15 to the relative positioning zones identified with the locators 30 is defined.

In order to guarantee a correct positioning of the layer of adhesive, the apparatus for depositing adhesive 20 is provided with a sensor device 35 which, like the sensor device 31 of the robotized manipulator 17, allows a correct movement of the depositing head 32, relative to the positions of the locators 30, and therefore of the positioning zones for the reinforcement elements 15.

In this case, therefore, the adhesive is deposited on the surface of the sheet 11 before the reinforcement elements 15 are deposited by the gripping head 26.

According to a variant, the apparatus for depositing adhesive 20, instead of being disposed in an intermediate position between the marker 19 and the robotized manipulator 17, can be provided in proximity to the exit of the feeder 21 of the loader 16, so as to supply the gripping head 26 with the reinforcement elements 15 already provided with a layer of adhesive on the contact surface of the sheet 11.

According to another variant, both the positioning solutions can exist at the same time for the apparatus for depositing adhesive 20, so as to provide to deposit both a layer of adhesive on the sheet 11 and a layer of adhesive on the reinforcement element 15.

The functioning of the unit 10 for working a sheet 11 according to the present invention is as follows.

The sheet 11 is fed along the direction of feed X and is subjected, in sequence:

- to an action of the marker 19 to deposit the locators 30 in correspondence to the predefined positioning zones;
- to the apparatus for depositing adhesive 20 for depositing the adhesive in correspondence to the locators 30; and
- to the robotized manipulator 17 to position the reinforcement elements 15 on the predefined zones previously glued.

Figure 2:
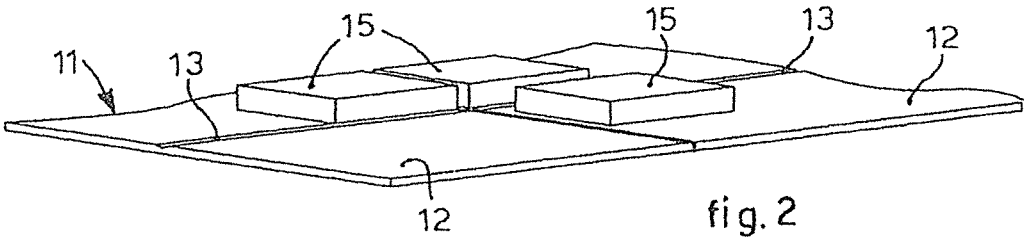
FIG. 2 schematically shows a reinforcement element applied on a sheet.

Upon exiting the unit 10 according to the invention, the sheet 11 thus has a plurality of reinforcement elements 15 on its surface, positioned in proximity to its edges, to the corners identified by the junction of the fold lines 13, and to the fold lines 13, for example, shown in FIG. 2.

Figure 3:
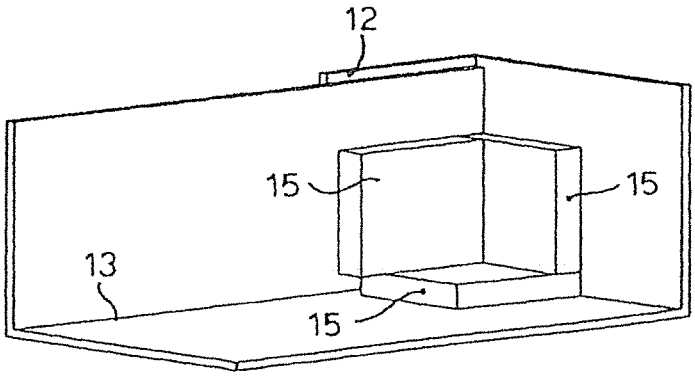
FIG. 3 schematically shows three reinforcement elements applied on a sheet in the folded condition.

From this positioning, actuating a coordinated folding of the lips 12, according to what is provided for the fanning of the box, the reciprocal positioning of the reinforcement elements 15 is defined so as to form substantially a single corner reinforcement element which extends on three different Cartesian planes (FIG. 3).

It is clear that modifications and/or additions of parts may be made to the unit 10 and to the relative working method as described heretofore, without departing from the field and scope of the present invention.

For example, it also comes within the field of the present invention to provide, instead of the apparatus for depositing adhesive 20, a constraint apparatus which provides to insert mechanical members, such as staples, tacks, nails, rivets or other, in order to constrain the reinforcement element 15 to the sheet 11, after its positioning.

According to this variant, the apparatus is disposed downstream of the robotized manipulator 17, with respect to the direction of feed X.

It also comes within the field of the present invention to provide, instead of the reinforcement elements 15 of a parallelepiped shape with a square base, reinforcement elements 15 of other shapes, for example parallelepiped with a rectangular, cylindrical or other base which is in any case substantially flat and easily obtainable by cutting, or by shearing a semi-worked piece.

Figure 4:
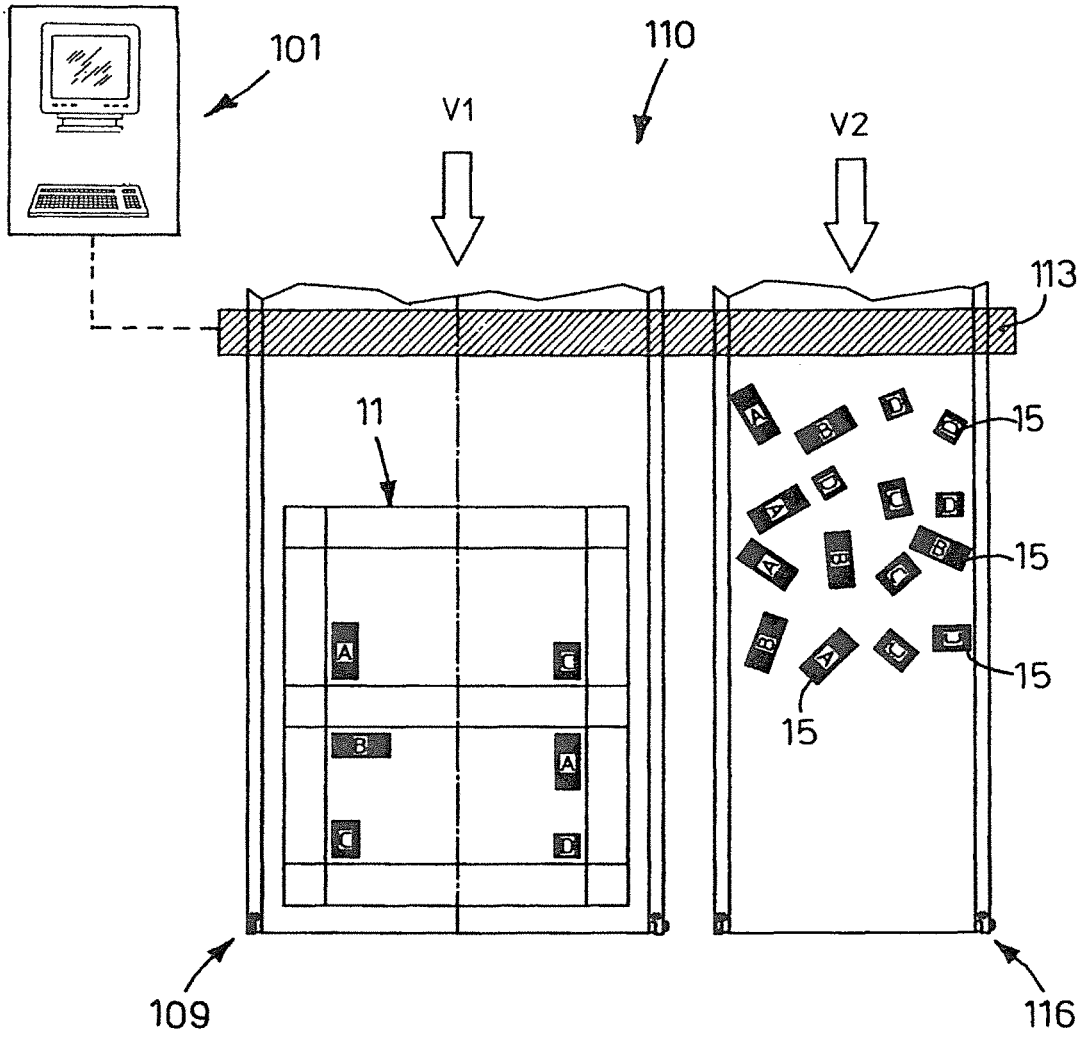
FIG. 4 schematically shows a form of embodiment of a working unit of the present invention.

FIG. 4 shows a simplified variant embodiment of the present invention, indicated by the reference number 110, in which some common parts and components common to the form of embodiment in FIG. 1 are not shown, for ease of interpretation.

The variant in FIG. 4 does not use gripping means 17 but presupposes that an operator manually positions the reinforcement elements 15 in the precise positions which, on each occasion and also according to the type and format of the sheet which must be worked, are marked on the sheet 11 thanks to the instructions received from a command and control unit 101, always following the logic of the positioning pattern discussed above.

In this variant 110, a first conveyor 109 is provided in order to move the sheet 11 forward along a first direction of feed V1.

Moreover, a second conveyor 116 is provided, which feeds the reinforcement elements 15 haphazardly along a second direction of feed V2, parallel to the first direction of feed V1.

The speed of feed of the first conveyor 109 and the second conveyor 116 can be different or the same, according to needs, and are duly coordinated.

The reinforcement elements 15 are of different types, in terms of shape and spatial sizes, and identified in FIG. 4 by means of different letters A, B, C, D, and in practice, can be combined with optical or visual marker elements, or other locators, in a similar manner to the locators 30 described above, again for the purposes of recognition and identification.

Figure 6:
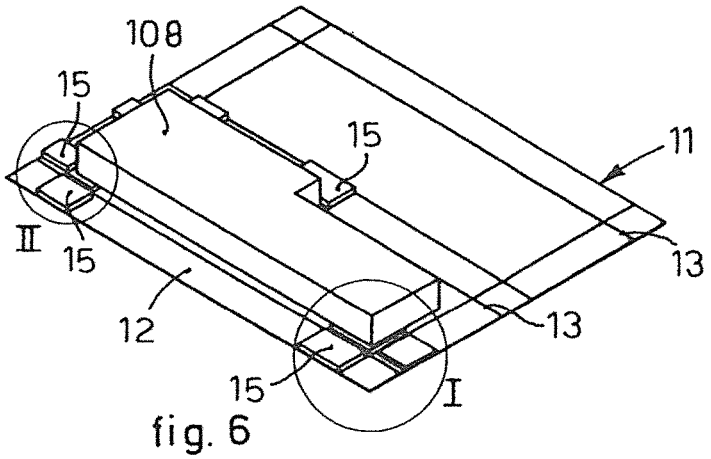
FIG. 6 schematically shows the positioning of a product to be packaged in a box made according to the present invention.
Figure 7:
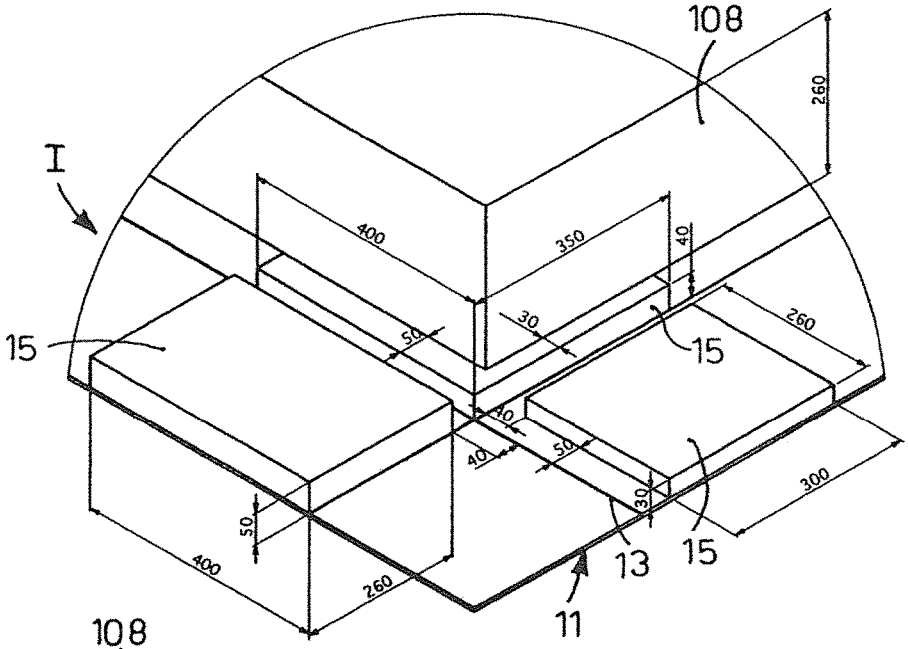
FIGS. 7 and 8 are respectively enlarged details I and II of FIG. 6.
Figure 8:
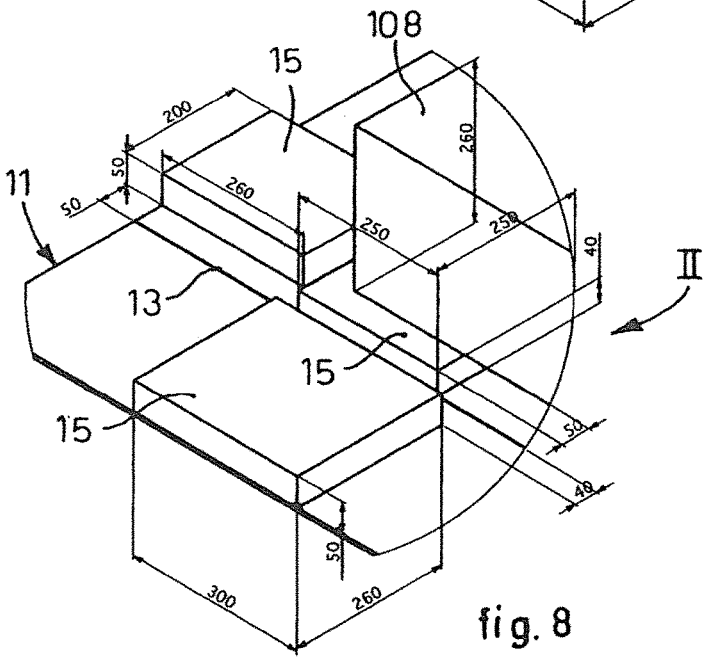

Providing reinforcement elements 15 having different shapes and sizes can be needed because of the fact that, as shown as an example in FIGS. 6-8, the product to be packaged, in this case a component of a furnishing element indicated by the reference number 108, can have a complex shape, with various angles, steps, levels and undercuts which follow one another along the perimeter, and therefore several reinforcement elements 15 of various types are needed, to adapt to this complex shape and guarantee an overall protection along the perimeter.

According to the variant 110 in FIG. 4, optical viewing means 113 are provided which cover at least the transverse width of the first conveyor 109 at least for the segment in which the sheet 11 is deposited.

The first optical viewing means 113, which can be a camera, for example of the CMOS or CCD type, are configured to acquire, continuously or in stages, an image of the sheet 11 advancing along the first direction V1, and to transfer the image acquired to the command and control unit 101.

The command and control unit 101, according to specific processing and recognition algorithms and to pre-loaded work programs and associated to the various types of format of sheets to be worked, is suitable to supply the necessary information for the positioning of the reinforcement elements 15 to the possible marker 19, in order to coordinately dispose or make the locators 30 in the desired positions on the sheets 11.

Moreover, the command and control unit 101 is suitable to supply the information also to the operator, in order to command the start of the positioning step, in this case, of the manual type, of the reinforcement elements 15 on the sheet 11 and to indicate which types of reinforcement elements 15 are to be positioned in the specific positions identified by the locators 30; the locators 30 can be the same or different depending on the type, shape and size of the reinforcement elements 15 associated with them, which are to be positioned.

In this form of simplified embodiment, the reinforcement elements 15 are selected visually and manually by the operator, according to the information he receives from the command and control unit 101, either a single time for example at the beginning of the work cycle, or continuously during the working.

Advantageously, as in FIG. 4, the first optical viewing means 113 can also involve the transverse width of the second conveyor 116, so as to acquire the images also from the reinforcement elements 15 fed, and possibly so as to be able to signal to the command and control unit 101 loading anomalies or defects, lack of material or similar situations in which it is necessary to intervene on the work line, stopping, accelerating or slowing down the movement.

Figure 5:
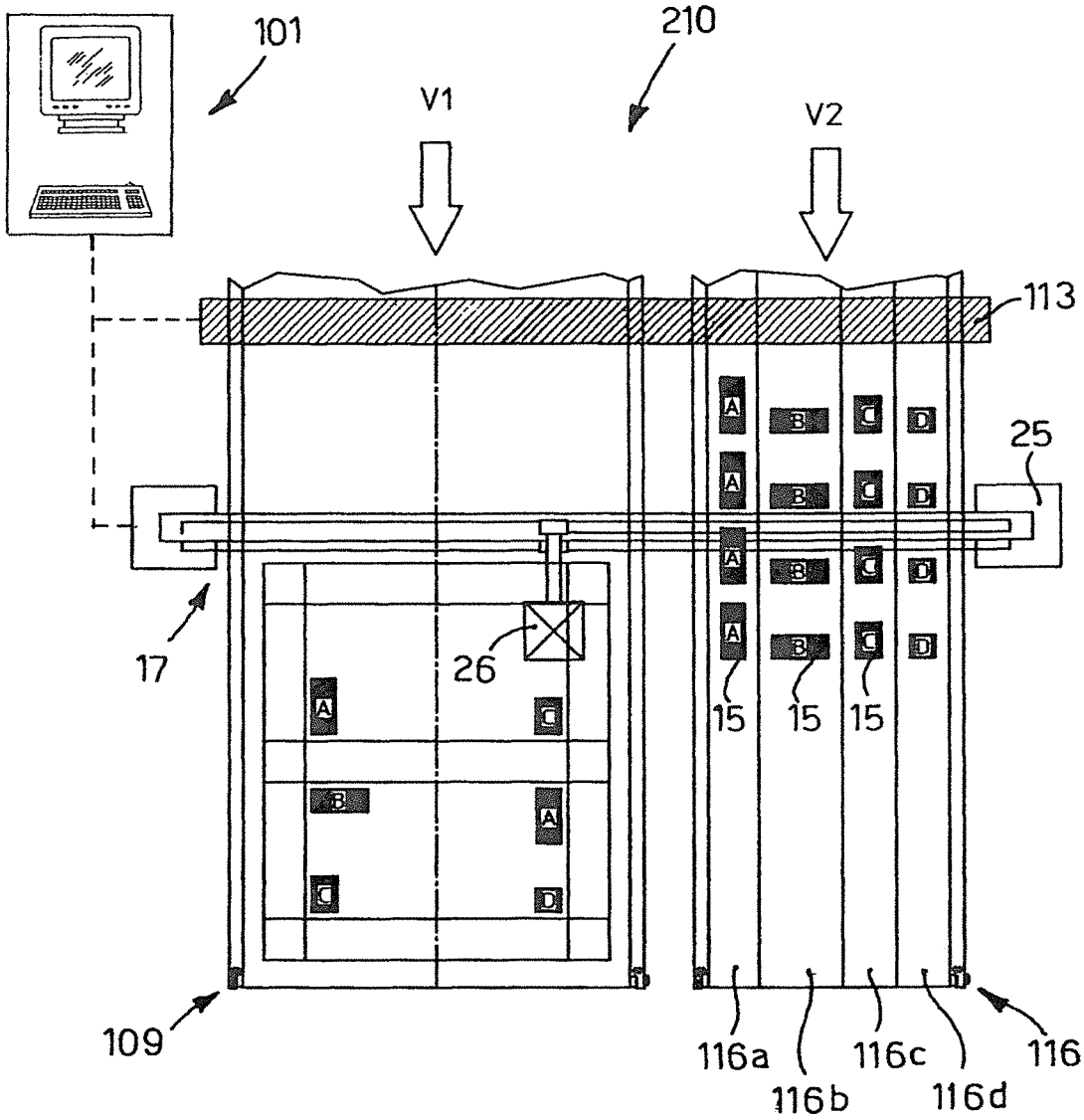
FIG. 5 schematically shows another form of embodiment of a working unit of the present invention.

FIG. 5 shows a variant, indicated by the reference number 210, which takes as a basis the solution in FIG. 4, and in addition provides that the manipulation and disposition of the reinforcement elements 15 is carried out automatically by means of the gripping means 17 already described.

In variant 210, the first conveyor 116 has a plurality of lanes 116*a*, 116*b*, 116*c*, 116*d* which develop parallel, separated from each other, along the second direction of feed V2 and are configured to move and to feed in an independent manner the different types of reinforcement elements 15 along directions parallel to the second direction of feed V2.

As can be seen in FIG. 5, the reinforcement elements 15 are separate and grouped according to type, indicated by A, B, C and D in FIG. 5, upstream of the second conveyor 116, manually or by means of a selector device, and thus directed in organized groups toward the respective lanes 116*a*-116*d* which make them advance, preferably in line one after the other, to facilitate the action of the gripping means 17.

Preferably, in this variant solution 210, the speed of feed of the reinforcement elements 15 along the second conveyor 116 is equal to the speed of feed of the sheet 11 along the first conveyor 109.

Moreover, in this variant, the optical viewing means 113 involve at least transversely both the first conveyor 109 and the second conveyor 116, so as to perform the same function already described on the first conveyor 109, and moreover, to acquire images of the organized groups of reinforcement elements 15 along the second conveyor 116.

According to the images acquired by the optical viewing means 113, the command and control unit 101 not only influences the operations of the marker 19 as described above, but is also suitable to stabilize the loading state of the reinforcement elements 15 along the second conveyor 116, detecting possible defects and anomalies as has already been described. It is also able to determine, with precision, the reciprocal spatial position between the reinforcement elements 15 and the zones, indicated by the deposited locators 30, where the reinforcement elements 15, also according to the format and type of sheet 11 to be worked, have to be positioned on the sheet 11 by the automatic gripping means 17.

In this way, the command and control unit 101 can automatically condition the functioning of the gripping means 17 which, according to which reinforcement element 15 they must pick up and position, carry out precise and coordinated spatial movements between a selected one of the lanes 116*a*-116*d* and the desired zones of the sheet 11 in which to dispose the selected reinforcement element 15, according to the cited positioning pattern.

FIGS. 6 and 7 clearly show the complexity and non-banality of the positioning of the reinforcement element 15 in order to protect the component of the furnishing element 108 which the present invention allows to make in a precise and reliable manner.

In FIGS. 6 and 7, the heights are indicated in millimeters and given as an example, to show the narrow tolerances allowed, and therefore the need for a precise reciprocal positioning of the reinforcement elements 15 in correspondence to the corners of the furnishing element component 108.

As can be seen in the examples in FIGS. 6 and 7, for a furnishing element component 108 with a thickness of about 260 mm, reinforcement elements 15 are shown as an example with a thickness of about 30, 40 or 50 mm and plane sizes of about 260 mm×400 mm and 260 mm×300 mm for the lateral reinforcement elements 15, or 350 mm×400 mm for the reinforcement element 15 disposed under the furnishing element component 108 (FIG. 7) or 200 mm×260 mm and 260 mm×300 mm for the lateral reinforcement elements 15 or 250 mm×250 mm for the reinforcement element 15 disposed under the furnishing element component 108 (FIG. 8), depending on the shapes used and on the positioning destinations.

As can be seen in FIGS. 7 and 8, it is necessary to position the reinforcement elements 15 with precision, reliability and repeatability, very near to the edges of the furnishing element component 108, about 40 mm in the example, and to the fold lines 13, about 50 mm in the example, or, for the reinforcement element 15 intended to be disposed under the furnishing element component 108, protruding by about 30 mm or 50 mm from the edges of the latter.

Thanks to the synergic cooperation and automated actuation with the gripping means, the marker member and the optical viewing means, the present invention is able to easily manage even the complex production of boxes of unusual, varied, irregular or complex shapes, and is able to dispose the reinforcement elements 15 in the desired positions in every case, with the sizes and tolerances shown for example above and with the high precision required.

The invention claimed is:

1. An apparatus for making boxes with reinforced corners, comprising:

an input for receiving a sheet of material with predetermined fold lines defining panels, wherein junctions of the fold lines define corners of the panels, and wherein the corners of the panels define corners of a box;

a loader for loading reinforcement elements, each reinforcement element having a length and a width defining rectangular top and bottom surfaces, and wherein each reinforcement element has a uniform thickness less than the length or the width;

a gripper movable between a first gripping position in which the gripper picks up the reinforcement elements presented by the loader, and a second position, in which the gripper attaches the reinforcement elements to the sheet in a predetermined positioning pattern, wherein the predetermined positioning pattern includes the placement a plurality of physically separate reinforcement elements at each junction of two fold lines, with a portion of each reinforcement element being disposed immediately adjacent to or in contact with both of the two fold lines, such that when the sheet of material is folded into the box, portions of the reinforcement elements at each junction are disposed immediately adjacent to, overlapping with, or in contact with one another to form a reinforced inside corner.

2. The apparatus of claim 1, wherein the predetermined positioning pattern includes three physically separate reinforcement elements at each junction of two fold lines, and wherein a portion of each reinforcement element is disposed immediately adjacent to or in contact with both of the two fold lines.

3. The apparatus of claim 1, wherein the predetermined positioning pattern further includes the reinforcement elements, portions of which are disposed immediately adjacent to or in contact with at least one fold line.

4. The apparatus of claim 1, further comprising:

a marker to place a plurality of locators on the sheet for indicating locations of the predetermined positioning pattern.

5. The apparatus of claim 4, further comprising:

a gluer for depositing an adhesive on the sheet at positions identified by the locators and/or directly on the reinforcement elements.

6. The apparatus of claim 4, further comprising a mechanical elements insertion member for attaching the reinforcement elements to the sheet at positions identified by the locators.

7. The apparatus of claim 1, wherein the loader includes a cutter for cutting the reinforcement elements to predetermined sizes.

8. The apparatus of claim 1, further comprising:

a marker for depositing a plurality of visual locators on the sheet, according to the predetermined positioning pattern, so as to identify positions for guiding the gripper to position the reinforcement elements.

9. The apparatus of claim 8, wherein the visual locators are made by printing or with incisions.

10. The apparatus of claim 8, further including a reader for identifying the visual locators on the sheet.

11. The apparatus of claim 8, wherein the gripper includes an optical viewing and image acquisition unit for forming an image of part of the sheet to identify the visual locators.

12. The apparatus of claim 11, wherein the gripper is able to move the optical viewing and image acquisition unit respectively in correspondence to the reinforcement elements and/or the visual locators.

13. The apparatus of 31, wherein the optical viewing and image acquisition unit identifies the visual locators.

14. The apparatus of claim 1, wherein the gripper includes an optical viewing and image acquisition unit for forming an image of the reinforcement elements fed by the loader.

15. The apparatus of claim 1, wherein the gripper includes a support bridge and a gripping head assembled sliding on the support bridge, the gripping head being movable between at least the first gripping position and the second position.

16. The apparatus of claim 1, wherein the gripper includes an arm able to move the gripping head at least between the first gripping position and the second position.

17. An apparatus for making boxes with reinforced corners, the apparatus comprising:

an input for receiving a sheet of material with predetermined fold lines defining panels, junctions of the fold lines defining corners of the panels, the corners of the panels defining corners of a box;

a loader for loading, according to a desired order, one or more reinforcement elements, each reinforcement element having a length and a width defining rectangular top and bottom surfaces, and wherein each reinforcement element has a uniform thickness less than the length or the width;

a marker for depositing a plurality of visual locators on the sheet according to a predetermined positioning pattern, so as to identify positions on which the reinforcement elements are disposed, wherein the predetermined positioning pattern includes a plurality of physically separate reinforcement elements at each junction of two fold lines, and a portion of each reinforcement element being disposed immediately adjacent to or in contact with both of the two fold lines, such that when the sheet of material is folded into the box, portions of the reinforcement elements are disposed immediately adjacent to, overlapping with, or in contact with each other to form a reinforced inside corner; and an optical viewing and image acquisition unit for acquiring images of the sheet and transmitting those images to a command and control unit which is configured to supply, according to the images acquired, information associated with the sheet so as to coordinate at least the automatic functioning of the marker.

18. The apparatus of claim 17, further comprising:

a gripper movable between a first gripping position in which the gripper cooperates with the loader to pick up one or more of the reinforcement elements, and a second position, in which, according to commands received from the command and control unit, the gripper automatically position the reinforcement elements on the sheet, according to the predetermined positioning pattern.

19. A method for forming boxes with reinforced corners, the method comprising:

feeding a sheet along a direction of movement, on which sheet specific cutting and pre-creasing workings have been made along the direction, so as to define relative fold lines on the sheet, the fold lines defining panels, junctions of the fold lines defining corners of the panels, the corners of the panels defining corners of a box;

providing a plurality of reinforcement elements, each reinforcement element having a length and a width defining rectangular top and bottom surfaces, and wherein each reinforcement element has a uniform thickness less than the length or the width;

attaching reinforcement elements on the sheet according to a predetermined positioning pattern, wherein the predetermined positioning pattern includes a plurality of physically separate reinforcement elements at each junction of two fold lines, and a portion of each reinforcement element being disposed immediately adjacent to or in contact with both of the two fold lines, such that when the sheet of material is folded into the box, portions of the reinforcement elements are disposed immediately adjacent to, overlapping with, or in contact with each other to form a reinforced inside corner; and folding along the fold lines to form the box.

20. The method of claim 19, further comprising:

loading the reinforcement elements to a gripper according to a desired order, and in the attaching step the reinforcement elements are gripped from the loader and then attached on the sheet, according to the predetermined positioning pattern, by the gripper movable between a first gripping position and a second position.

21. The method of claim 19, further comprising:

marking a plurality of visual locators on the sheet in order to identify positions on which the reinforcement elements are attached according to the predetermined positioning pattern.

22. The method of claim 21, further comprising:

acquiring images of the sheet fed by a feeder and transmitting them to a command and control unit which, according to the images acquired, supplies necessary information of the sheet and coordinates the marking step automatically.

* * * * *